US005722191A

United States Patent [19]

Morgan

[11] Patent Number: 5,722,191

[45] Date of Patent: Mar. 3, 1998

[54] CRAFT HOOP ASSEMBLY WITH GRIPPING SURFACE

[76] Inventor: Robert Elliott Morgan, 2255 NE. Porter Rd., Blue Springs, Mo. 64014

[21] Appl. No.: 679,702

[22] Filed: Jul. 11, 1996

Related U.S. Application Data

[63] Continuation-in-part of Ser. No. 546,559, Oct. 20, 1995, Pat. No. 5,555,653, which is a continuation-in-part of Ser. No. 379,889, Jan. 27, 1995, abandoned.

[51] Int. Cl.[6] ..... D06C 3/08

[52] U.S. Cl. ..... 38/102.2

[58] Field of Search ..... 38/102, 102.1, 38/102.2, 102.91; 101/127.1; 160/371, 374.1, 380, 402, 382

[56] References Cited

U.S. PATENT DOCUMENTS

| | | | |
|---|---|---|---|
| 627,821 | 6/1899 | Gurnee . | |
| 699,263 | 5/1902 | Vosler . | |
| 758,535 | 4/1904 | Howden . | |
| 879,654 | 2/1908 | Kohler . | |
| 928,598 | 7/1909 | Gibbs . | |
| 935,841 | 10/1909 | Fife . | |
| 989,597 | 4/1911 | Gibbs . | |
| 1,010,534 | 12/1911 | Totten et al. . | |
| 1,077,987 | 11/1913 | Keagy | 38/102.2 |
| 1,229,857 | 6/1917 | Alyea . | |
| 1,248,783 | 12/1917 | Andrews . | |
| 1,332,395 | 3/1920 | Hachmann . | |
| 1,574,364 | 2/1926 | Carlson . | |
| 2,063,901 | 12/1936 | Wicander . | |
| 2,198,128 | 4/1940 | Roberts et al. . | |
| 3,520,224 | 7/1970 | Hensley et al. . | |
| 3,729,045 | 4/1973 | MacDonald . | |
| 3,855,718 | 12/1974 | Parsons et al. . | |
| 3,885,751 | 5/1975 | Kelch et al. . | |
| 3,950,869 | 4/1976 | Samarin . | |
| 4,357,885 | 11/1982 | Stockton . | |
| 4,432,381 | 2/1984 | Greenbaum . | |
| 4,451,997 | 6/1984 | Jones . | |
| 4,485,574 | 12/1984 | Bennetot . | |
| 4,558,904 | 12/1985 | Schultz . | |
| 4,571,864 | 2/1986 | Bopp . | |
| 4,644,629 | 2/1987 | Moore, III . | |
| 4,644,639 | 2/1987 | Atteberry et al. . | |
| 4,658,522 | 4/1987 | Kramer . | |
| 4,723,367 | 2/1988 | Samoilov et al. . | |
| 4,860,467 | 8/1989 | Larson . | |
| 5,555,653 | 9/1996 | Morgan | 38/102.2 |

FOREIGN PATENT DOCUMENTS

| | | |
|---|---|---|
| 1957248 | 5/1971 | Germany . |

*Primary Examiner*—Ismael Izaguirre
*Attorney, Agent, or Firm*—Litman, McMahon & Brown

[57] ABSTRACT

A craft hoop assembly for securing material on which a craft is to be performed comprises an inner hoop or ring having an outer surface and a split outer hoop or ring having an inner surface which is positionable in circumscribing alignment with the inner ring such that the inner surface of the outer ring generally abuts against the outer surface of the inner ring. A bead is integrally formed on either the inner surface of the outer ring or the outer surface of the inner ring. A corresponding groove is formed in the opposing surface of the inner or outer ring respectively. Projections, ridges or bumps are integrally formed on the inner surface of the outer ring or the outer surface of the inner ring or both to increase the gripping effect of the rings on fabric secured therebetween. The projections are preferably formed on said bead. The projections may be randomly arranged or arranged in specific patterns to enhance the gripping effect.

15 Claims, 2 Drawing Sheets

Fig. 1.
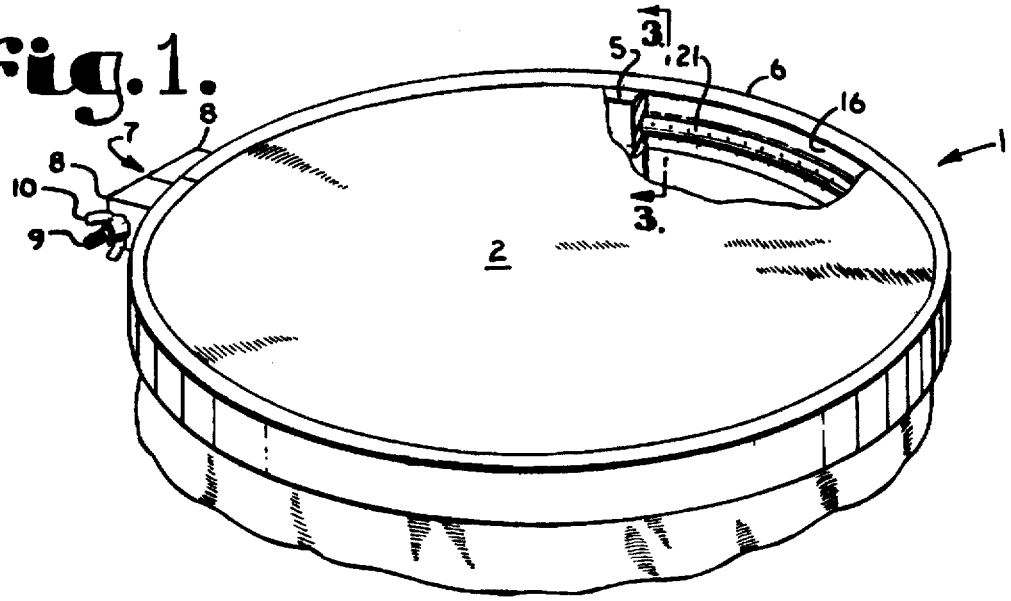
Fig. 3.
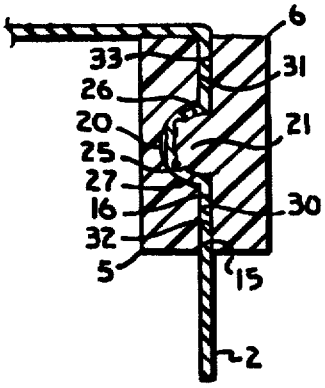
Fig. 2.
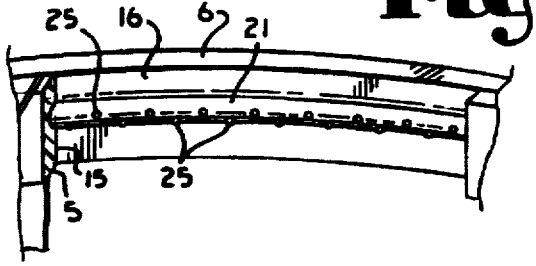
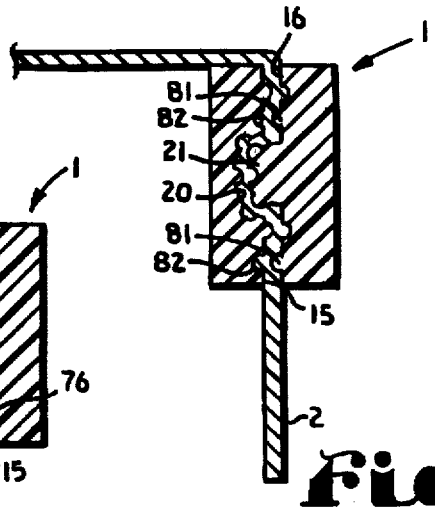
Fig. 11.
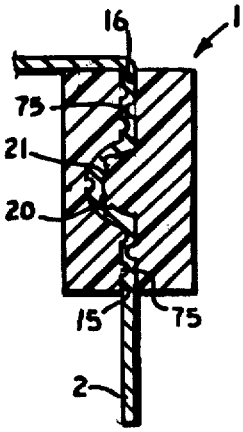
Fig. 9.
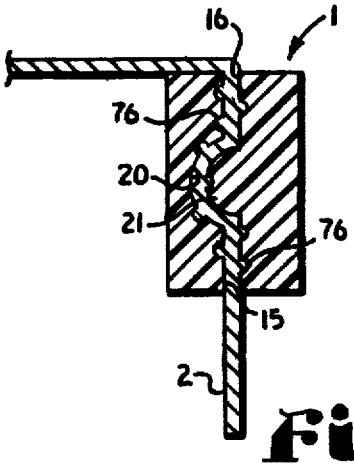
Fig. 10.

CRAFT HOOP ASSEMBLY WITH GRIPPING SURFACE

CROSS REFERENCE TO RELATED APPLICATIONS

This application is a continuation-in-part of application Ser. No. 08/546,559, filed Oct. 20, 1995, which issued as U.S. Pat. No. 5,555,653 on Sep. 17, 1996, and which is a continuation-in-part of application Ser. No. 08/379,889, entitled IMPROVED CRAFT HOOP ASSEMBLY, filed Jan. 27, 1995 and now abandoned.

BACKGROUND OF THE INVENTION

The present invention relates to craft hoops and more particularly to a craft hoop incorporating structure to more securely hold fabric secured by the craft hoop.

Craft hoops of the prior art generally comprise concentric inner and outer rings. The inner ring has a fixed diameter and the outer ring has an adjustable diameter. Material upon which a craft is to be performed is placed across the inner ring. The outer ring is then placed over the material and around the inner ring and the diameter of the outer ring is then adjusted such that the outer ring fits snugly against the material and inner ring so as to hold the material between the two rings. Craft work is then performed on the material held taut between the two rings.

The rings of most craft hoops on the market have smooth abutting surfaces between which the fabric is secured. Pulling and pressing on the fabric while performing a craft causes the fabric to slide between the rings. Recognizing this problem, several attempts have been made to increase the grip on the fabric by making the abutting surfaces of the inner and outer hoops irregular and by securing strips of resilient, flexible material to one or more of the rings. The strips of flexible material such as felt or leather have been secured to the ring by gluing. The gluing process is labor intensive and the adhesive bond often deteriorates relatively quickly.

Although wooden hoops have been extremely popular, the escalating cost of wood has increased demand for hoops made of alternative materials such as plastic. Plastic hoops generally provide even less frictional resistance than wooden hoops. Therefore the demand and need for effective yet inexpensive means for securing or gripping material between such hoops has increased. Currently available systems have failed to meet this need.

SUMMARY OF THE INVENTION

The present invention generally comprises an improved craft hoop assembly for securing material on which a craft is to be performed. The craft hoop assembly comprises an inner hoop or ring having an outer surface and a split outer hoop or ring having an inner surface. The outer ring is positionable in circumscribing alignment with the inner ring such that the inner surface of the outer ring generally abuts against the outer surface of the inner ring. The craft hoop assembly includes griping means for more firmly securing material positioned between the inner and outer rings. The gripping means generally comprises a bead which is integrally formed on either the inner surface of the outer ring or the outer surface of the inner ring. A corresponding groove is formed in the opposing surface of the inner or outer ring respectively. Projections, ridges or bumps are integrally formed on the inner surface of the outer ring or the outer surface of the inner ring to increase the gripping effect of the rings on fabric secured therebetween. The projections are preferably formed on said bead. The projections may be randomly arranged or arranged in specific patterns to enhance the gripping effect.

OBJECTS AND ADVANTAGES OF THE INVENTION

Therefore, it is an object of the invention to provide an improved craft hoop assembly that more effectively grips material secured between inner and outer rings of the craft hoop assembly; to provide such a craft hoop assembly that is relatively simple and inexpensive to manufacture; to provide such a craft assembly which is simple to use; and to provide such a craft hoop which is particularly well adapted for its intended usage.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a craft hoop assembly of the present invention with portions broken away to show interior detail and showing an inner ring with a circumferential groove formed therein and an outer ring with a circumferential bead formed thereon and the bead includes a plurality of projections formed thereon.

FIG. 2 is an enlarged and fragmentary view of a portion of the craft hoop assembly shown in FIG. 1.

FIG. 3 is an enlarged and fragmentary cross-sectional view taken along line 3—3 of FIG. 1.

FIG. 9 is a cross-sectional view similar to FIG. 3, showing an alternative embodiment of the present invention.

FIG. 10 is a cross-sectional view similar to FIG. 3, showing an alternative embodiment of the present invention.

FIG. 11 is a cross-sectional view similar to FIG. 3, showing an alternative embodiment of the present invention.

DETAILED DESCRIPTION OF THE INVENTION

Figure 6:
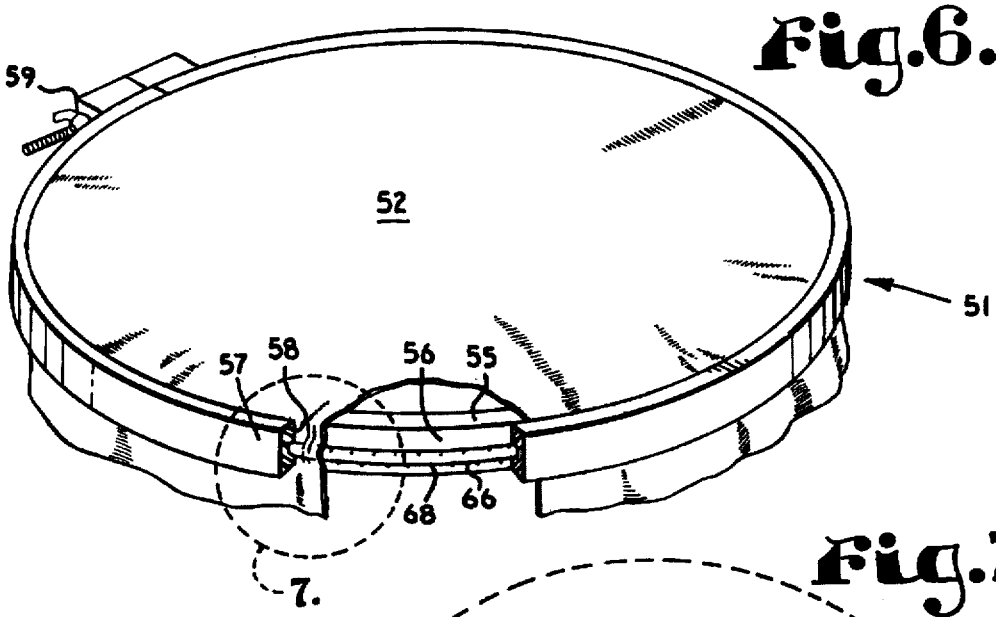
FIG. 6 is a perspective view of an alternative embodiment of the craft hoop assembly of the present invention with portions broken away to show detail.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 refers to an improved craft hoop assembly of the present invention for use in securing thereto material 2 on which a craft is to be performed. The size of the assembly is variable to accommodate materials 2 from a wide range of crafts including: needlepoint, embroidery and quilting. The assembly comprises an inner ring or hoop 5 and a split outer ring or hoop 6. The rings or hoops 5 and 6 are preferably formed from molded plastic but may be formed from wood, metal, or other fairly rigid materials.

The outer ring 6 includes clamping means such as clamp 7 for adjusting the diameter of the outer ring 6. Clamp 7, as shown, comprises a pair of opposed ears 8, each mounted on an end of the split outer ring 6, and also includes a bolt 9 extending through coaxial apertures in each ear 8 to be secured by a nut 10. The outer ring 6 is sized such that the outer ring 6 may be positioned in encircling or circumscribing alignment with the inner ring 5. Tightening of the nut 10 on the bolt 9 urges the ears 8 and the ends of the outer ring 6 together so as to reduce the diameter of the outer ring 6 and to generally constrict the outer ring 6 around the inner ring 5.

The inner ring 5 includes an outer surface 15 and the outer ring 6 includes an inner surface 16. A groove 20 is formed in the inner ring outer surface 15 circumferentially therearound and preferably centrally thereof. A projection, ridge or bead 21 is integrally formed on the outer ring inner surface 15 and extends circumferentially therearound preferably centrally thereof. The bead 21 is sized, shaped and positioned such that the bead 21 extends at least partially within the groove 20 in the inner ring 5 when the outer ring 6 is positioned in circumscribing alignment therewith.

A plurality of hemispherical projections, bumps or bosses 25 are formed on the bead 21. As shown in FIG. 2, the projections 25 are alternatively spaced around the bead 21 between an upper portion 26 and a lower portion 27 of the bead 21. It is foreseen that the projections 25 could be spaced in a wide variety of configurations.

The projections 25 are preferably formed only along the bead 21. The outer ring 6 may be tightened relative to the inner ring 5 such that flat portions 30 and 31 of the inner ring outer surface 15 abut flat portions 32 and 33 of the outer ring inner surface 16 respectively. As generally shown in FIG. 3, when material 2 is secured between the rings 5 and 6, the outer ring 6 may therefore be tightened relative to the inner ring 5 such that the material 2 is pressed flush between the flat portions 30 and 32 and 31 and 33 respectively.

The radius of the bead 21 is slightly smaller than the radius of the groove 20 such that when the outer ring 6 is positioned in circumscribing alignment with the inner ring 5 a gap is formed between the outer ring inner surface 16 along the bead 21 and the inner ring outer surface 15 along the groove 20. The projections 25 on the bead 21 are preferably sized to press the material 2 extending into the groove 20 against the inner ring outer surface 15 along the groove 20 where the material 2 extends across the projections 25, thereby providing additional surface contact and frictional resistance between the material 2 and the rings 5 and 6.

Figure 4:
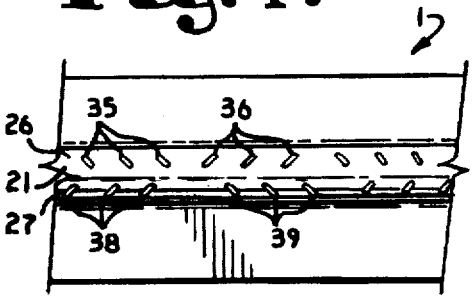
FIG. 4 is a front plan view of an inner surface of an outer ring of an alternative embodiment of the craft hoop assembly of the present invention incorporating projections of a different shape and configuration.

FIG. 4 shows an alternative embodiment of the present invention. A first sub set of projections or elongate ridges 35 and a second sub set of projections or elongate ridges 36 are integrally formed on the upper portion 26 of the bead 21 in adjacent alignment. The first sub set of ridges 35 is angled in a first direction relative to a centerline of the bead 21 (downward from left to right at approximately a forty-five degree angle as shown in FIG. 4). The second sub set of ridges 36 is angled in a second or opposite direction relative to the centerline of the bead 21 (upward from left to right at approximately a forty-five degree angle as shown in FIG. 4).

A third and fourth sub set of projections or elongate ridges 38 and 39 are integrally formed on the lower portion 27 of the bead 21 in adjacent alignment. The third sub set of ridges 38 is angled in the second direction relative to the centerline of the bead 21 and is generally positioned below the first sub set of ridges 35. The fourth sub set of ridges 39 is angled in the first direction relative to the centerline of the bead 21 and is generally positioned below the second sub set of ridges 36. The point at which each of the ridges in the third and fourth sub sets of ridges 38 and 39 intersects the centerline is preferably offset relative to the point at which each of the ridges in the first and second sub set of ridges 35 and 36 intersects the centerline respectively.

As shown in FIG. 4, the pattern of orientation of the ridges on the upper and lower portions 26 and 27 of the bead 21 is repeated around the bead 21. It is foreseen that the ridges may only be formed on selected portions of the bead 21 or all the way around.

The ridges comprising the first, second, third and fourth sub sets of ridges 35, 36, 38 and 39 on the bead 21 are preferably sized to press the material 2 extending into the groove 20 against the inner ring outer surface 15 along the groove 20, thereby providing additional surface contact and frictional resistance between the material 2 and the rings 5 and 6.

Figure 5:
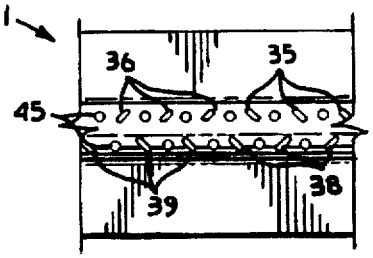
FIG. 5 is a front plan view of an inner surface of an outer ring of an alternative embodiment of the craft hoop assembly of the present invention incorporating projections of different shapes and configuration.

FIG. 5 shows an alternative embodiment of the craft hoop assembly 1 wherein hemispherical projections or bumps 45 are formed on the bead 21 between each of the ridges forming the first, second, third and fourth sub sets of ridges 35, 36, 38 and 39.

Figure 7:
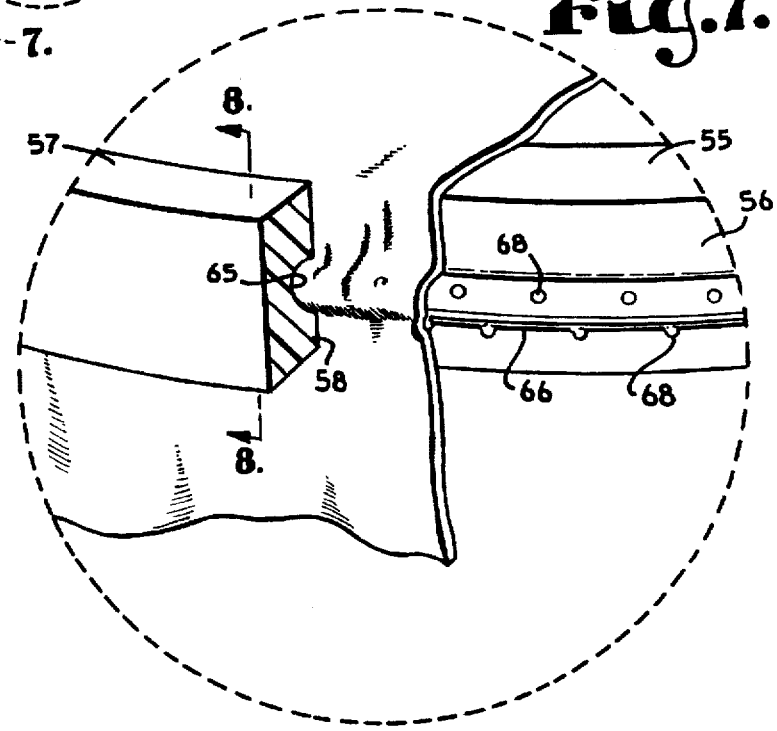
FIG. 7 is an enlarged and fragmentary view of a portion of the craft hoop assembly shown in FIG. 6.
Figure 8:
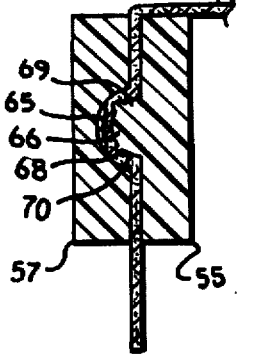
FIG. 8 is a fragmentary cross-sectional view taken along line 8—8 of FIG. 7.

FIGS. 6 through 8 disclose an alternative embodiment of a craft hoop assembly 51 of the present invention, similar to the embodiment as shown in FIG. 1. The craft hoop assembly 1 is adapted for securing material 52 thereon and comprises an inner ring 55 having an outer surface 56 and outer ring 57 having an inner surface 58 and a clamping assembly 59. A groove 65 is formed in the outer ring 57 on the inner surface 58 and a bead 66 is integrally formed on the inner ring 55 on the outer surface 56. The bead 66 is sized, shaped and positioned such that the bead 66 extends at least partially within the groove 65 when the outer ring 57 is positioned in circumscribing alignment with the inner ring 55.

A plurality of hemispherical projections, bumps or bosses 68 are formed on the bead 66. As shown in FIG. 7, the projections 68 are alternatively spaced around the bead 66 between an upper portion 69 and a lower portion 70 of the bead 66. It is foreseen that the projections 68 could be of various shapes and spaced in a wide variety of configurations.

FIG. 9 shows an alternative embodiment similar to the embodiment shown in FIG. 1 and having a plurality of projections, ridges or bosses 75 formed on both the inner ring outer surface 15 and the outer ring inner surface 16 including along the groove 20 and bead 21 and on the flat portions 30, 31, 32 and 33. It is foreseen that the projections 75 may be of a wide variety of shapes and configurations or patterns.

FIG. 10 shows an alternative embodiment similar to the embodiment shown in FIG. 1 and having a plurality of indentations, grooves, slots, and dimples 76 formed on both the inner ring outer surface 15 and the outer ring inner surface 16 including along the groove 20 and bead 21 and on the flat portions 30, 31, 32 and 33. It is foreseen that the indentations 76 may be of a wide variety of shapes and configurations or patterns for example, the indentations 76 may be hemispherical or elongate.

FIG. 11 shows an alternative embodiment similar to the embodiment shown in FIG. 1 and having a plurality of projections, ridges and bosses 81 and a plurality of indentations, grooves, slots, and dimples 82 formed on both the inner ring outer surface 15 and the outer ring inner surface 16 including along the groove 20 and bead 21 and on the flat portions 30, 31, 32 and 33. It is foreseen that the projections 81 and the indentations 82 may be of a wide variety of shapes and configurations or patterns.

It should be noted that the invention is not intended to be limited to the specific configurations of projections indentations shown and that various configurations may be utilized to provide different gripping characteristics.

It should also be noted that the relative dimensions of the fabric have been exaggerated to more clearly demonstrate the preferred embodiment.

It is to be understood that while certain forms of the present invention have been illustrated and described herein, it is not to be limited to the specific forms or arrangement of parts described and shown.

What is claimed and desired to be secured by Letters Patent is as follows:

1. A craft hoop assembly for securing material on which a craft is to be performed comprising:

a. an inner ring having an outer surface;

b. an outer ring having an inner surface and positionable in circumscribing alignment with said inner ring;

c. a first of said inner ring and said outer ring having a groove formed in said outer surface or said inner surface respectively and extending circumferentially therearound;

d. a second of said inner ring and said outer ring having a bead integrally formed on said outer surface or said inner surface respectively and extending at least partially therearound; said bead sized, shaped and positioned on said second ring such that said bead extends at least partially within said groove in said first ring when said outer ring is positioned in circumscribing alignment with said inner ring; and e. a plurality of projections formed on said bead or along said groove or both.

2. The craft hoop assembly as in claim 1 wherein:

(a) at least some of said projections are hemispherical.

3. The craft hoop assembly as in claim 1 wherein:

(a) at least some of said projections comprise elongate ridges.

4. The craft hoop assembly as in claim 1 further comprising:

(a) clamping means for adjusting the diameter of the outer ring for securing material on which a craft is to be performed between said inner and outer rings.

5. The craft hoop assembly as in claim 1 further comprising:

(a) a plurality of indentations formed on said inner ring outer surface or said outer ring inner surface or both.

6. A craft hoop assembly for securing material on which a craft is to be performed comprising:

(a) an inner ring having an outer surface;

(b) an outer ring having an inner surface and positionable in circumscribing alignment with said inner ring;

(c) a first of said inner ring and said outer ring having a groove formed in said outer surface or said inner surface respectively and extending circumferentially therearound;

(d) a second of said inner ring and said outer ring having a bead integrally formed on said outer surface or said inner surface respectively and extending at least partially therearound; said bead sized, shaped and positioned on said second ring such that said bead extends at least partially within said groove in said first ring when said outer ring is positioned in circumscribing alignment with said inner ring; and (e) a plurality of indentations formed on said inner ring outer surface or said outer ring inner surface or both.

7. The craft hoop assembly as in claim 6 wherein:

(a) said indentations are formed in said bead or along said groove or both.

8. The craft hoop assembly as in claim 6 wherein:

(a) at least some of said indentations are hemispherical.

9. The craft hoop assembly as in claim 6 wherein:

(a) at least some of said indentations are elongate.

10. The craft hoop assembly as in claim 6 further comprising:

(a) clamping means for adjusting the diameter of the outer ring for securing material on which a craft is to be performed between said inner and outer rings.

11. A craft hoop assembly for securing material on which a craft is to be performed comprising:

(a) an inner ring having an outer surface;

(b) an outer ring having an inner surface and positionable in circumscribing alignment with said inner ring;

(c) a first of said inner ring and said outer ring having a groove formed in said outer surface or said inner surface respectively and extending circumferentially therearound;

(d) a second of said inner ring and said outer ring having a bead integrally formed on said outer surface or said inner surface respectively; said bead sized, shaped and positioned on said second ring such that said bead extends at least partially within said groove in said first ring when said outer ring is positioned in circumscribing alignment with said inner ring; and (e) a first set of projections integrally formed on an upper portion of said bead and a second set of projections integrally formed on a lower portion of said bead; said first set of projections comprises a plurality of elongate ridges angled in a first direction relative to a centerline of said bead; and said second set of projections comprises a plurality of elongate ridges angled in a second direction relative to a centerline of said bead.

12. The craft hoop assembly as in claim 11 wherein:

(a) said first set of projections on said upper portion of said bead further comprises a plurality of elongate ridges angled in said second direction relative to said centerline; and (b) said second set of projections on said lower portion of said bead further comprises a plurality of elongate ridges angled in said first direction relative to said centerline.

13. The craft hoop assembly as in claim 11 wherein;

(a) said first set of projections on said upper portion of said bead comprises a first sub set of elongate ridges angled in said first direction relative to said centerline and a second sub set of elongate ridges angled in said second direction relative to said centerline and positioned laterally adjacent to said first sub set of elongate ridges; and (b) said second set of projections on said lower portion of said bead comprises a third sub set of elongate ridges angled in said second direction relative to said centerline and positioned below said first sub set of elongate ridges on said upper portion of said bead and a fourth sub set of elongate ridges angled in said first direction relative to said centerline and positioned adjacent said third sub set of elongate ridges and below said second set of elongate ridges.

14. The craft hoop assembly as in claim 11 further comprising:

(a) a hemispherical projection formed on said bead between each of said ridges.

15. The craft hoop assembly as in claim 11 further comprising:

a plurality of indentations formed on said inner ring outer surface or said outer ring inner surface or both.

* * * * *